United States Patent [19]

Horikoshi et al.

[11] Patent Number: 4,515,365

[45] Date of Patent: May 7, 1985

[54] DEVICE FOR MEASURING SWING DATA OF BASEBALL BAT

[75] Inventors: Hiroshi Horikoshi; Akio Arai; Sadayuki Tsukagoshi; Junichi Sakamoto, all of Gumma, Japan

[73] Assignee: Mitsubishi Denki Kabushiki Kaisha, Tokyo, Japan

[21] Appl. No.: 592,456

[22] Filed: Mar. 22, 1984

[30] Foreign Application Priority Data

| | | | |
|---|---|---|---|
| Mar. 23, 1983 | [JP] | Japan | 58-41520[U] |
| Mar. 23, 1983 | [JP] | Japan | 58-41522[U] |
| Mar. 23, 1983 | [JP] | Japan | 58-41523[U] |
| Mar. 23, 1983 | [JP] | Japan | 58-41524[U] |
| Mar. 23, 1983 | [JP] | Japan | 58-41525[U] |

[51] Int. Cl.[3] ..... A63B 71/02

[52] U.S. Cl. ..... 273/25; 434/247

[58] Field of Search ..... 273/26 R, 26 A, 26 B, 273/72 R, 32 H, 25, 181 H, 181 E, 181 A, 181 G, 186 R, 186 B, 186 C, 186 RA, 67 R; 434/247, 252

[56] References Cited

U.S. PATENT DOCUMENTS

| | | | |
|---|---|---|---|
| 3,117,451 | 1/1964 | Ray et al. | 273/26 R |
| 3,531,116 | 9/1970 | Trzesniewski | 273/26 R |
| 4,150,825 | 4/1979 | Wilson | 273/DIG. 28 |
| 4,254,956 | 3/1981 | Rusnak | 273/181 H |
| 4,296,476 | 10/1981 | Mayer et al. | 273/DIG. 28 |
| 4,306,722 | 12/1981 | Rusnak | 273/186 R |

FOREIGN PATENT DOCUMENTS

| | | | |
|---|---|---|---|
| 1565688 | 1/1969 | France | 273/25 |
| 113549 | 6/1982 | Japan . | |

*Primary Examiner*—Richard C. Pinkham
*Assistant Examiner*—MaryAnn Stoll Lastova
*Attorney, Agent, or Firm*—Bernard, Rothwell & Brown

[57] ABSTRACT

Apparatus for measuring and analyzing the swing of a baseball player. The apparatus includes devices for emitting a plurality of spaced light beams projected in directions to be intersected by the swing plane of a bat and a corresponding plurality of light receiving elements arranged to receive light beams reflected from the bat. Signals received by the light receiving elements are collected and supplied to a processing apparatus and the results of this processing are displayed on a display unit which provides indication of angle, speed, level, etc. of the swing. The information may also be provided to a printer. The apparatus indicates whether the swing is performed normally and if it deviates from normal indicates the error involved.

4 Claims, 16 Drawing Figures

24

| No. | SPEED | LEVEL | ANGLE |
|---|---|---|---|
| 1 | 30.0 | 95.5 | +1.5 |
| 2 | 29.5 | 100.0 | ------ |
| ⋮ | ⋮ | ⋮ | ⋮ |
| MEAN | ------ | ------ | ------ |
| MAXIMUM | ------ | ------ | ------ |
| MINIMUM | ------ | ------ | ------ |

FIG. 11
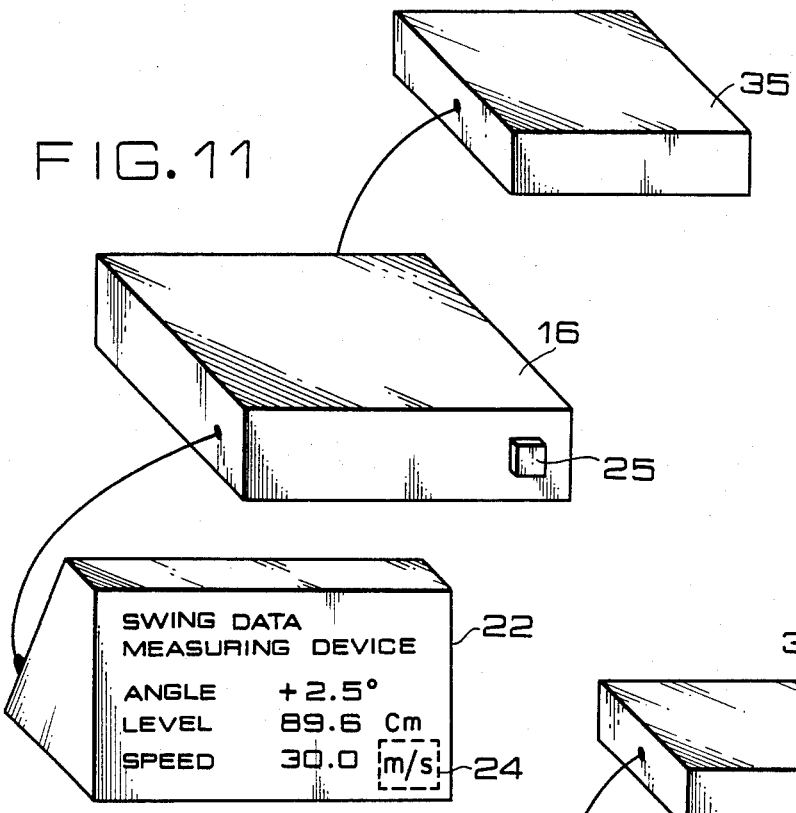
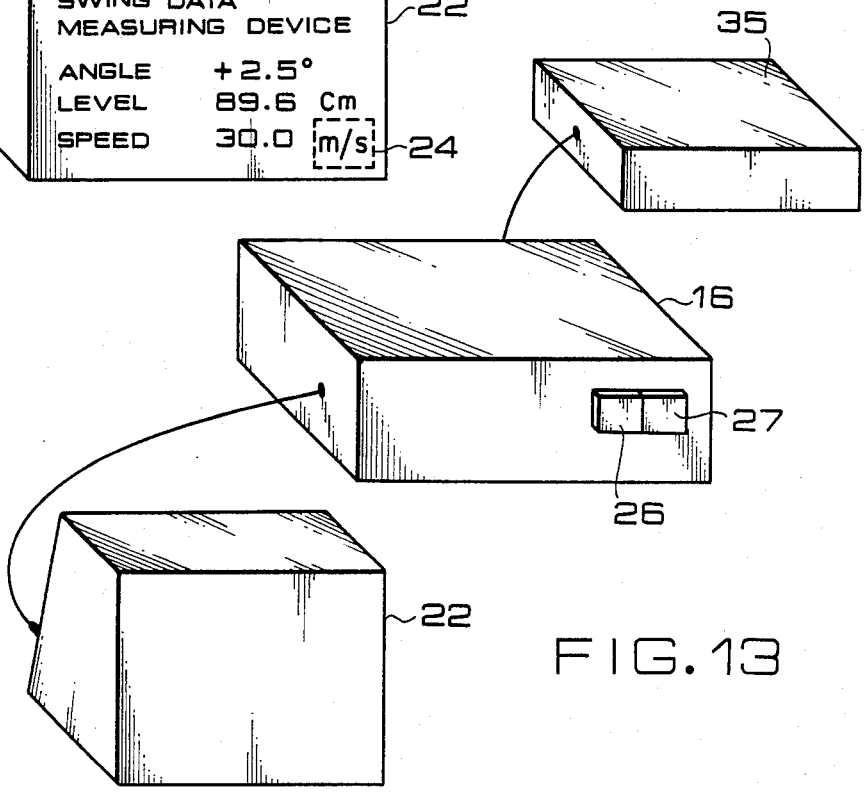
FIG. 13

DEVICE FOR MEASURING SWING DATA OF BASEBALL BAT

BACKGROUND OF THE INVENTION

1. Field of the Invention

This invention relates to a swing data measuring device in which various data of swing really played when a baseball player exercises bat swing, such as level of passing trace of a bat, angle of the trace with respect to a prescribed reference line and the speed of the bat passing through the trace, can be detected optically and displayed as digital value being understandable readily. Swing data obtained may be utilized as scientific index to improve swing of the player himself.

2. Description of the Prior Art

Measurement of swing data of a bat swung by a baseball player can be performed by optically detecting that two lines being nearly perpendicular to the ground are intersected by the bat and processing the intersection and the time required for the intersecting by electronic means.

A swing data measuring device on the basis of this principle in the prior art is shown in FIG. 1, and use state thereof is in FIG. 2. In FIG. 2, reference numeral 1 designates a baseball bat to be swung by a player, numeral 2 a light reflecting sheet applied to a peripheral surface of the bat 1 adjacent to top end preferably to peripheral surface of sweet spot portion, and numeral 3 a swing data measuring device. The device 3 as shown in FIG. 1 comprises four light emitting/receiving apparatuses 31, 32, 33, 34, a display unit 4, and switch buttons $S_1$, $S_2$ for changing the display content in the display unit 4. The light emitting/receiving apparatuses 31–34 comprise light emitting means $A_1$, $A_2$, $A_3$, $A_4$ for emitting light beams 3*a*, 3*b*, 3*c*, 3*d* intersecting the swing plane S of the bat 1 shown in FIG. 2, and light receiving means $C_1$, $C_2$, $C_3$, $C_4$ for receiving light reflected from the light reflecting sheet 2 applied to the bat 1.

Principle of the swing data measurement in this measuring device will be described referring to FIG. 3. In FIG. 3, X-axis is on the measuring apparatus 3 and Y-axis is taken on middle portion of distance between light beams from 3*a* to 3*d*. The trajectory axis S intersects the light beams 3*a*–3*d* and Y-axis at points $P_1$–$P_5$. $P_o$ is the intersection between beams 3*a*, 3*b* or between beams 3*c*, 3*d*, and the distance $h_o$ between $P_o$ and X-axis is constant value preset at the beam system. The distance h between the origin 0 of X-Y coordinates and the point $P_5$ represents level of the swing plane, and $\theta_1$ represents inclination angle of the trajectory axis S with respect to the horizontal plane. If the swing speed v is constant within the line segment $\overline{P_1P_4}$, the level h of the swing plane, the inclination angle $\theta_1$ and the speed v are represented respectively as follows:

$$h = \frac{r_1 \times r_2 + 1 - 2r_2}{2(r_1 - r_2)} \times h_o \, (r_1 \neq r_2) \tag{1}$$

$$\tan\theta_1 = \frac{1}{r_2 - 1}\left\{ (r_2 + 1) \times \frac{h}{a} - r_2 \times \frac{h_o}{a} \right\} \, (r_2 \neq 1) \tag{2}$$

$$v = \frac{2a(1 + \tan^2\theta_1)^{\frac{1}{2}}}{T_1 + T_3} \tag{3}$$

where

-continued $$r_1 = \frac{h_o - h - a\tan\theta_1}{h - a\tan\theta_1}$$

$$r_2 = \frac{h + a\tan\theta_1}{h_o - h + a\tan\theta_1}$$

$T_1$, $T_3$ represent the traveling time of line segments $\overline{P_1P_2}$ and $\overline{P_2P_4}$ respectively and may be measured by the measuring device 3.

FIG. 4 shows constitution of a measuring unit 35 which is provided with four pairs of light emitting sections A and light receiving sections C. In the light emitting section A, modulation signal from a modulator 6 passes through a driver 7 and is emitted as optical signal from a light emitting element 8. The optical signal is focused into luminous flux with prescribed spread by means of a lens system 9 and projected upwards through a beam splitter 10 as a half-mirror.

Reflected light from the light reflecting sheet 2 of the bat 1 intersecting the luminous flux is reflected about 90° by means of the beam splitter 10 and focused by the lens system 11 and entered into the light receiving element 12. Light-receiving signal is outputted from the light receiving element 12 and noise component is removed from the light-receiving signal by the filter amplifier 13 and the detector 14 thereby analog waveform corresponding to the reflected light is produced. The analog waveform is converted into digital waveform by a digitizer 15 and then outputted. The output is processed by a processing unit (not shown) and the processing result is displayed as level, angle of the swing plane and the swing speed in a display unit.

The swing data measuring device in the prior art as above described can measure the level of the swing plane, the angle thereof and the speed of the bat on the swing plane and display them. However, for the player using the measuring apparatus to know above-mentioned data scarcely becomes index to improve technique of the player. Because discrimination is impossible regarding to what degree above-mentioned data is different from data obtained by the correct or best swing.

SUMMARY OF THE INVENTION

An object of the invention is to provide a swing data measuring device of a baseball bat, which can easily compare swing data of a bat swung by a player with swing data to be obtained at the best swing and therefore serves to improve technique of the player significantly.

In an embodiment of the invention, a swing data measuring device comprises two light emitting means for emitting first and second light beams being in parallel by a prescribed spacing and directed in intersecting direction to swing plane of a bat, further two light emitting means for emitting third and fourth beams being directed in intersecting direction to the first and second light beams respectively, four light receiving means for receiving four reflection beams formed by reflection of the light beams on surface of the bat respectively, processing means for executing prescribed operation based on output signals from light receiving means and processing swing data including level and inclination of the swing plane and speed of the bat, display means for displaying the swing data processed by the processing means, collection means for collecting the past swing data obtained from swings already performed and processing the swing data of analysis result of whole swings obtained by analyzing the data collection, and means for displaying output data of the collection means.

In order to eliminate disadvantages that a measuring device acts, for example, during slight swing as warming up performed often before a swing and swing data of the slight swing is displayed, a swing data measuring device of the invention may be provided with means for canceling the swing data obtained from bat swing performed at speed outside a prescribed speed region.

According to another embodiment of the invention above-mentioned processing means can indicate the processed bat speed by any one of a plurality of units. Changing of units can be performed by changeover means such as a switch operated by a player.

According to another embodiment of the invention, a swing data measuring device has a fifth light emitting-/receiving means in addition to above-mentioned four light emitting/receiving means. The fifth light emitting-/receiving means is composed of a light emitting means for emitting a fifth light beam directed from middle portion between first and second light beams and in parallel to these beams and of a light receiving means for receiving the reflection light beam of the fifth light beam reflected on the bat surface. The fifth light beam provides means for obtaining two pieces of information regarding time required for the bat to intersect the first light beam and the fifth light beam and time required to intersect the fifth light beam and the second light beam. Comparing the two pieces of time information, whether or not the moving speed of the bat within a prescribed zone is increasing can be known and the result becomes index representing sharpness of the bat swing.

The invention further provides a swing data measuring device having a transparent cover to cover upper portion of the light emitting/receiving means. The cover protects the light emitting/receiving means from adhesion of dirt or rain water. The cover is attached in inclination with respect to the plane perpendicular to the light beam emitted from the light emitting means in the direction and angle so that the light beam is reflected on the cover surface and prevented from entering the light receiving means.

BRIEF DESCRIPTION OF THE DRAWINGS

FIG. 11 is a perspective view schematically illustrating a device as still another embodiment of the invention;

FIG. 13 is a schematical perspective view of a swing data measuring device as a fourth embodiment of the invention;

DETAILED DESCRIPTION OF THE PREFERRED EMBODIMENTS

Figure 1:
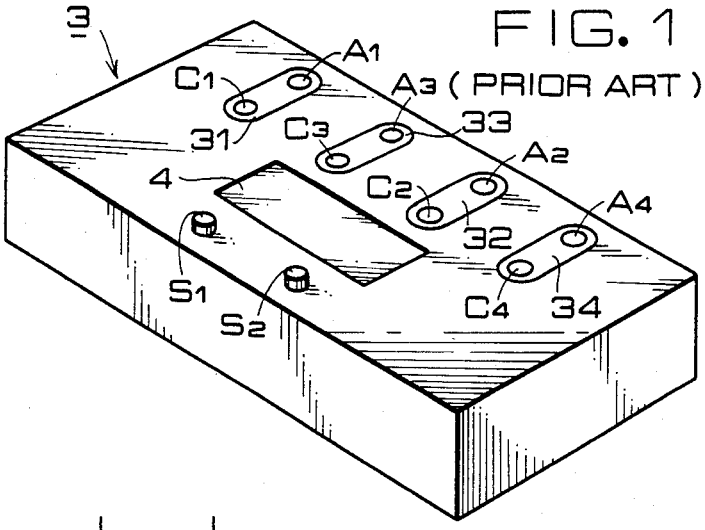
FIG. 1 is a perspective view of a swing data measuring device in the prior art.
Figure 2:
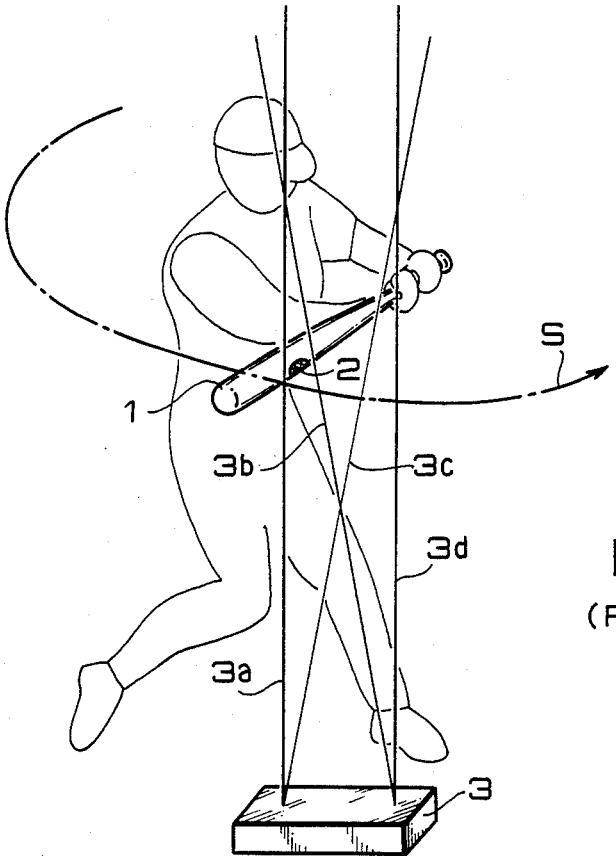
FIG. 2 (PRIOR ART)
FIG. 2 is a perspective view illustrating relation between a swing plane and light beams in use state of the device shown in FIG. 1.
Figure 4:
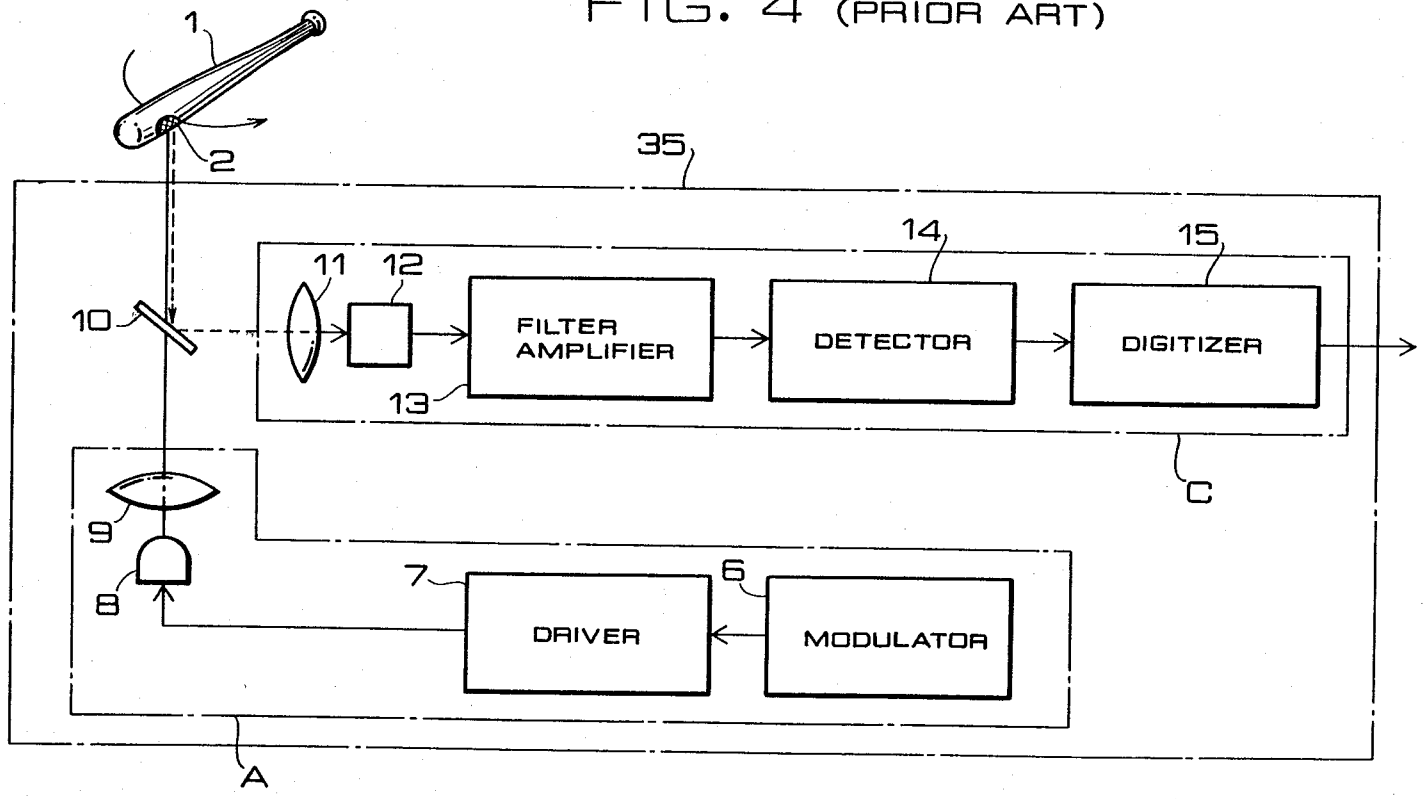
FIG. 4 (PRIOR ART)
FIG. 4 is a block diagram illustrating constitution of a measuring unit of the device of FIG. 1.
Figure 5:
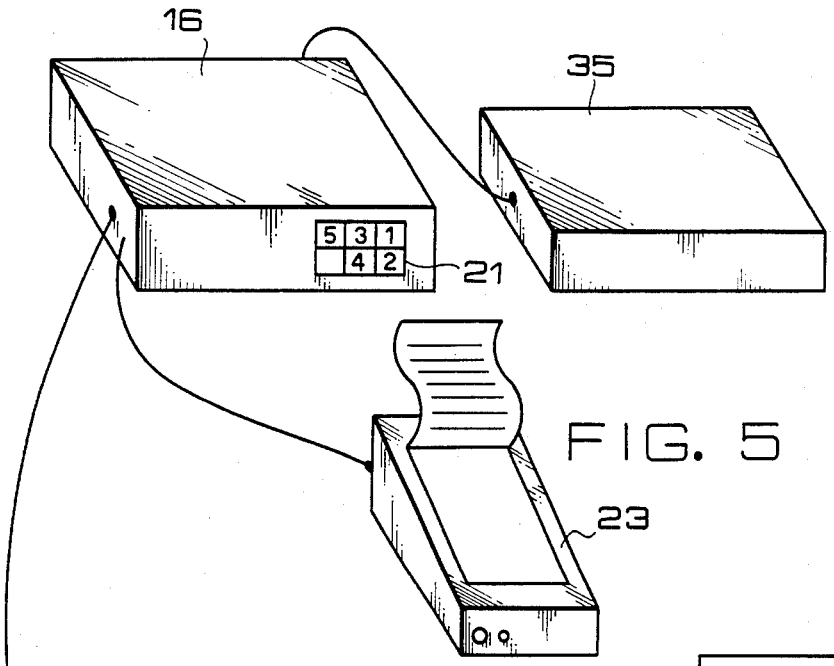
FIG. 5 is a perspective view schematically illustrating components of a swing data measuring device as an embodiment of the invention.
Figure 6:
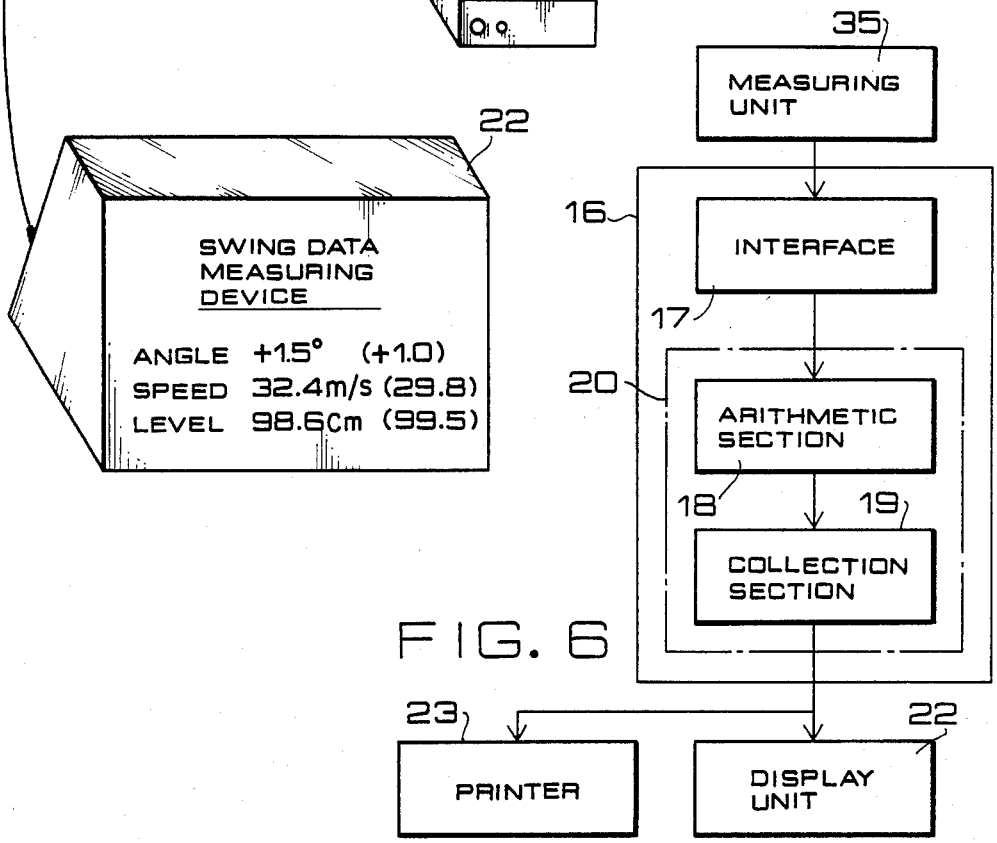
FIG. 6 is a block diagram of the device of FIG. 5.

In FIG. 5 showing a swing data measuring device as an embodiment of the invention, reference numeral 35 designates a measuring unit having, for example, appearance as shown in FIG. 1 and constitution as shown in FIG. 4. A processing unit 16 is composed of an interface 17 and a processing section 20 comprising an arithmetic section 18 and a collection section 19 as shown in FIG. 6, and connected to the measuring unit 35 through a cable. Operating buttons 21 supply required command to the processing section 20. A display unit 22 for performing digital display of output of the processing unit 16 and a printer 23 for printing output of the processing unit 16 are connected to the processing unit 16 through cables respectively. The printer 23 may be often omitted.

Figure 7:
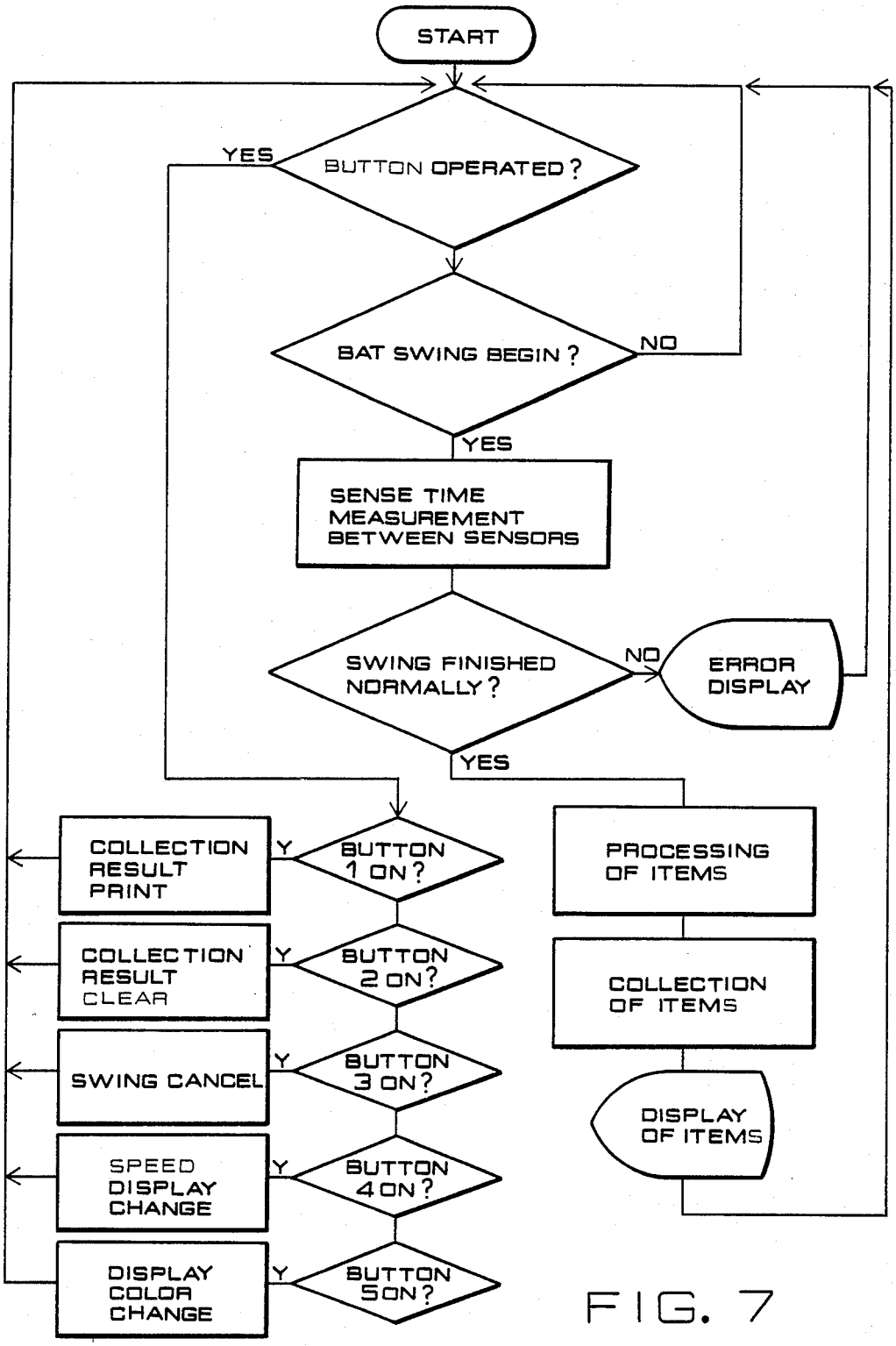
FIG. 7 is a working flow chart of the device of FIG. 5.

Operation of above-mentioned device will now be described referring to FIG. 7. First, decision is performed regarding whether or not the operating buttons 21 were operated by a user. If operated, which of the operating buttons 21 was operated is determined. If the button No. 1 was operated, the collection result is printed. Of the operating buttons No. 2–No. 5 were operated, collection result clear action, swing cancel action, speed display changing and display color charging of the display unit 22 are performed respectively. Next, whether or not the bat swing was begun is determined. If begun, sensing time between sensors is measured, that is, timing of the bat intersecting the light beams 3*a*–3*d* is measured. Thereby whether or not the swing was finished normally is determined. If not normal, the error display is performed and the operation is returned to the beginning; if normal, operation of various items is performed at the arithmetic section 18 and then collection and analysis of various items are performed at the collection section 19. Consequently, in the collection section 19, not only data of speed, angle, level of individual swing but also mean value, maximum and minimum of swing data and the number of swings may be obtained. The display unit 22 receives output of the collection section 19 and displays data of angle, speed, level in individual swings and mean value in whole swings without abnormal swings. The printer 23 receives output of the collection section 19 and prints all data collected and analyzed in the collection section 19 onto a printing paper 24 as shown in FIG. 8.

Swing data which are displayed in the display unit 22 or printed by the printer 23 include data of the last swing and the analysis result estimated from swing data collection of whole swings performed hereinbefore. Based on comparison of both, the player can easily determine what is to be taken care of at next swing; thereby the rapid proficiency of the technique may be expected.

Figures 8, 9:
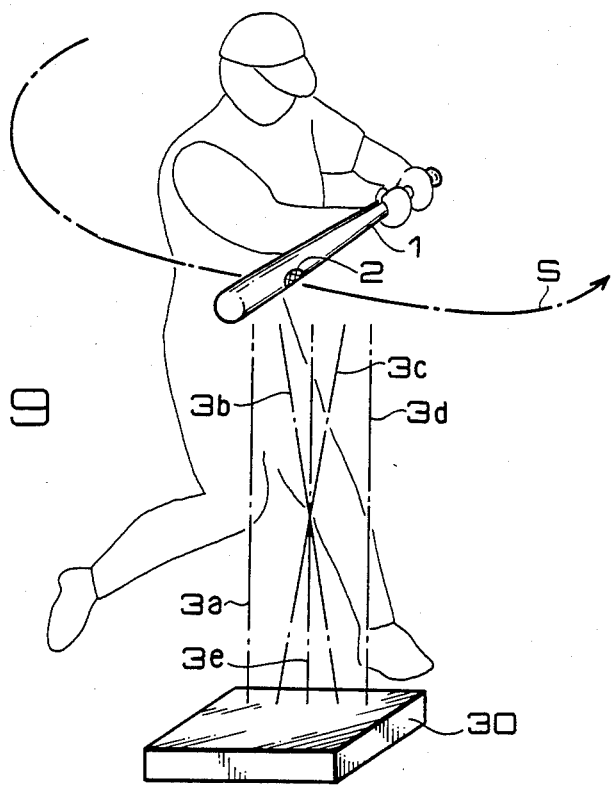
FIG. 8 is a plan view illustrating an example of display content of a data sheet printed by a printer in the device of FIG. 5.
FIG. 9 is a perspective view illustrating relation between a swing plane and light beams in use state of a swing data measuring device as another embodiment of the invention.

In another embodiment of the invention shown in FIG. 9, a swing data measuring device 30 has light emitting means for emitting a fifth light beam 3*e* in addition to four light beams 3*a*, 3*b*, 3*c*, 3*d* and light receiving means for receiving the reflecting light of the fifth light beam 3*e* reflected on the bat surface. This light emitting/receiving means is the same as those for other four light beams and the detailed description thereof shall be omitted.

Figure 10:
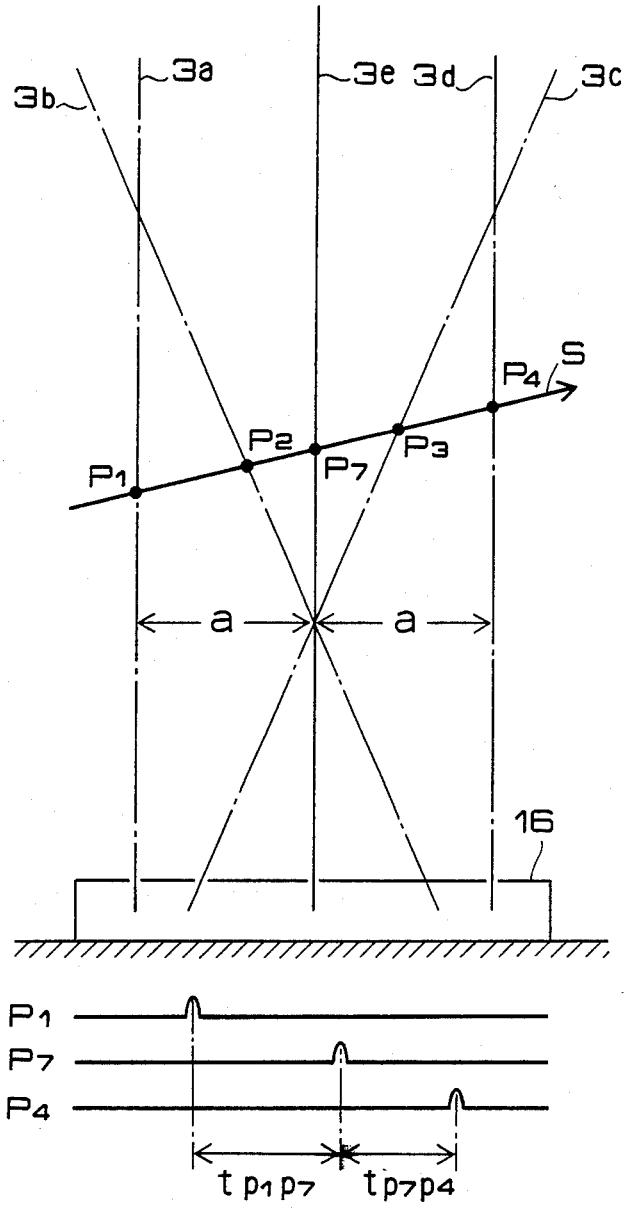
FIG. 10 is a graph illustrating principle to determine swing data from intersections between light beams and the swing plane in the device of FIG. 9.

As shown in FIG. 10, the fifth light beam 3*e* is directed in parallel to the first beam 3*a* and the fourth beam 3*d* from middle portion between both beams 3*a*, 3*d*. The light beams 3*a*–3*e* are reflected on the bat surface and then received by corresponding light receiving means, respectively. System for processing output signal of the light receiving means is fundamentally the same as that shown in FIG. 6 except the processing performed in the arithmetic member 18. The swing data measurement of the bat swing on the basis of time relation at receiving the reflected light of four light beams 3*a*, 3*b*, 3*c*, 3*d* is also similar to above-mentioned case.

Discrimination of the sharpness of the bat swing is performed on the basis of following principle. That is, in FIG. 10, $P_7$ is a point on which the bat 1 intersects the light beam 3*e*, and a light receiving unit receives reflected light from points $P_1$, $P_7$, $P_4$ intersecting light beams 3*a*, 3*e*, 3*d* respectively, thereby time $t_{p1p7}$ in which the bat 1 is traveled from $P_1$ to $P_4$ and time $t_{p7p4}$ in which the bat 1 is traveled from $P_7$ to $P_4$ are estimated. Since distance between $P_1$ and $P_7$ and distance $P_7$ and $P_4$ are equal, if $t_{p1p7} > t_{p7p4}$ for example, it follows that, when the swing speed is compared before the light beam 3*e* at middle portion intersects the bat 1 and after the beam 3*e* intersects the bat 1, the swing speed is higher after the intersecting than before the intersecting thereby sharpness of the swing is increased.

The light beam 3*e* need not be disposed at middle portion between the first light beam 3*a* and the second light beam 3*d*, but any point between both light beams 3*a*, 3*d* will do. Speed of the bat 1 while it is traveled from the light beam 3*a* to the light beam 3*e* (i.e. division of set distance by the travel time) is compared with speed of the bat 1 while it is traveled from the light beam 3*e* to the light beam 3*d* (i.e. division of set distance by the travel time) and it may be determined that the higher the increasing rate of the latter, the higher the sharpness of swing.

A swing data measuring device as still another embodiment of the invention shown in FIG. 11 comprises a measuring unit 35, a processing unit 16 and a display unit 22 in similar manner to that shown in FIG. 5. The display unit 22 displays swing data such as angle of the swing plane in degrees, level of the swing plane in centimeters, and speed in any unit on a variable display unit 24. Although the variable display unit 24 shown in FIG. 11 displays the speed in units of meters per second, operation of a changeover operating button 25 installed at the processing unit 16 enables display of symbol representing units of feet per second for example. In this state, the processing unit 16 outputs value of the measured speed converted into value corresponding to units of feet per second, for example.

Figure 12:
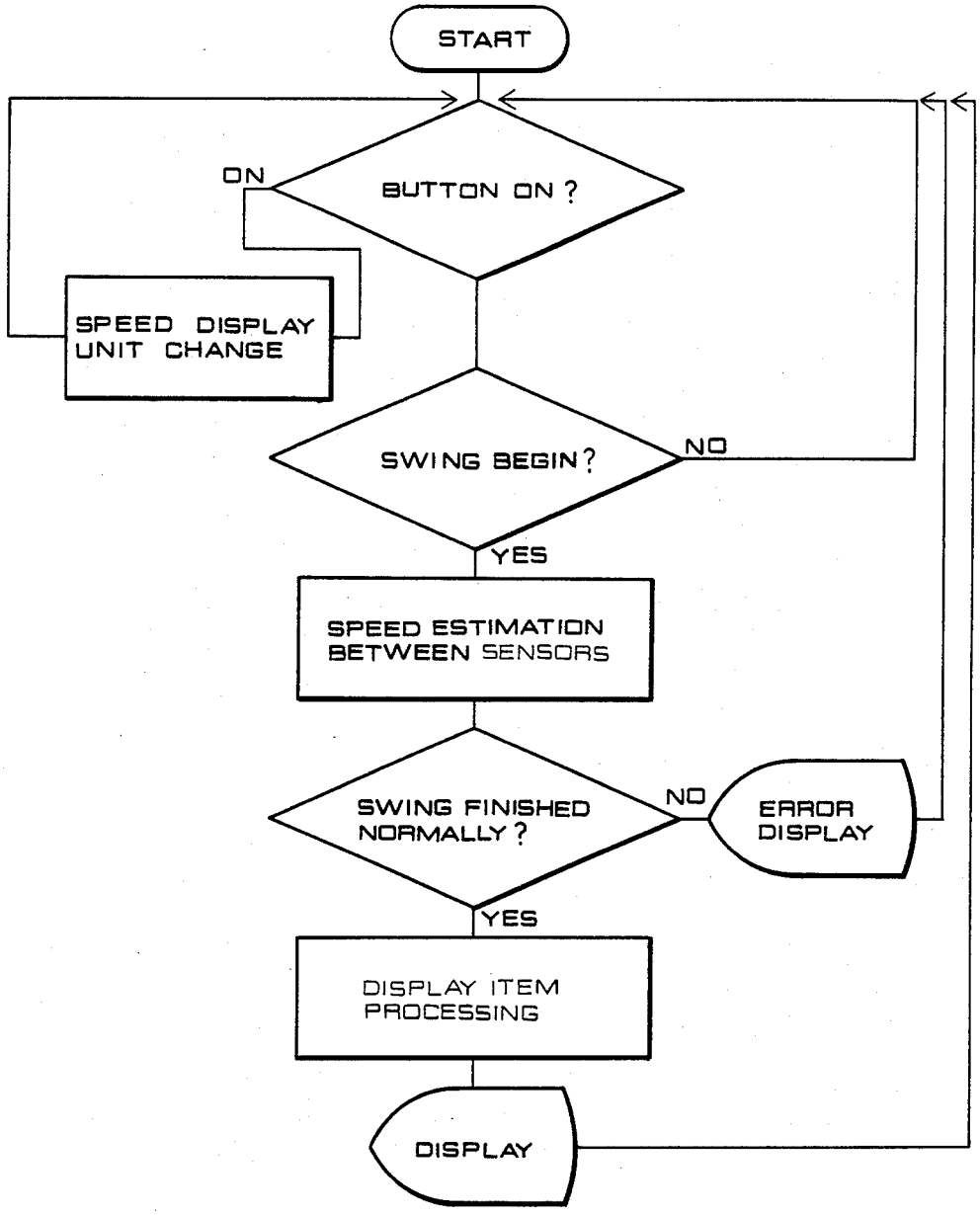
FIG. 12 is a working flow chart of the device of FIG. 11.

Operation of the apparatus will be described referring to a flow chart shown in FIG. 12. When the speed unit changeover button 25 is pushed, changing is performed in prescribed sequence and speed unit is displayed on the speed unit display unit 24, and at the same time the processing unit 16 executes the speed estimation corresponding to unit in the display unit. If the button 25 is pushed by a user, the processing unit 16 senses this action and specified speed unit is displayed on the speed unit display unit 24. If the specified unit is initially displayed, the button 25 need not be pushed. If the swing is begun, the processing unit 16 executes the speed estimation between various light beams based on data from the measuring unit 35. On the basis of the speed estimation, the processing unit 16 determines whether or not the swing was performed normally. If not normal, the error display is performed and the operation is returned to the initial state. If the swing was performed normally, display items, i.e. angle of the swing, level and speed (corresponding to the displayed unit) are processed and the display unit 22 displays various items.

Means for discriminating whether or not the swing really performed is normal may be means for discriminating the swing to be normal only when the swing speed is within a prescribed setting region. A swing data measuring device of the invention shown in FIG. 13 comprises a processing unit 16 having a speed upper-limit setting button 26 and a speed lower-limit setting button 27.

Figure 14:
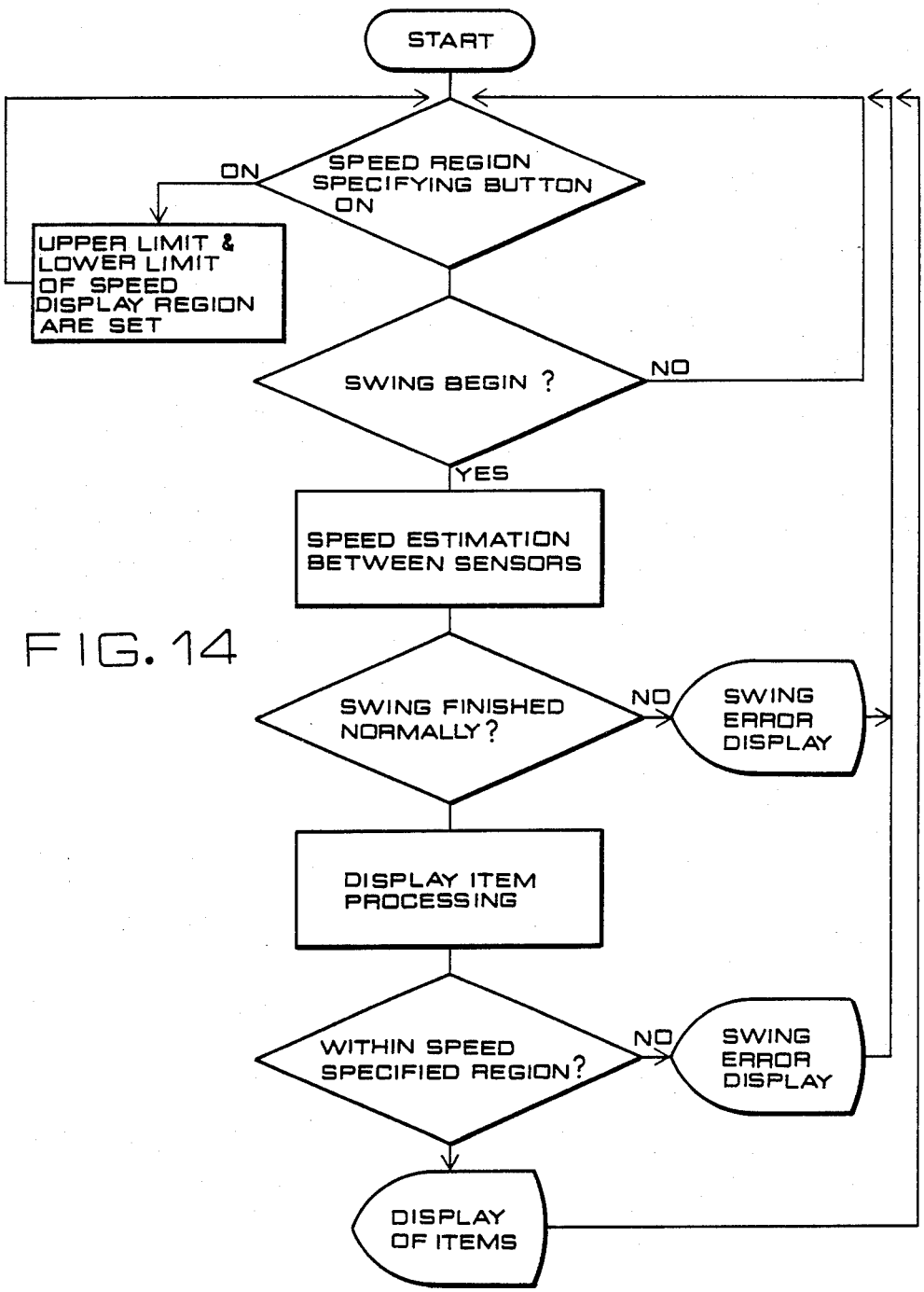
FIG. 14 is a working flow chart of the device of FIG. 13.

Operation of the apparatus will be described referring to a flow chart of FIG. 14. First, the buttons 26, 27 are turned on so as to set upper limit and lower limit of the speed display region. For example, the display unit 22 displays upper limit value and lower limit value, and these values vary at prescribed intervals every time the buttons 26, 27 are turned on. Next, the swing is begun and the speed of the bat 1 intersecting light beams 3*a*–3*d* is estimated. Based on the estimation, whether or not the swing was performed normally is determined. If not normal, the error display is performed and the operation is returned to the initial state. If the swing was performed normally, display items, i.e. angle of the swing plane and speed are processed. If the speed is outside the set region, the error display is performed and the operation is returned to the initial state; if it is within the set region, the display unit 22 displays various display items.

Figure 3:
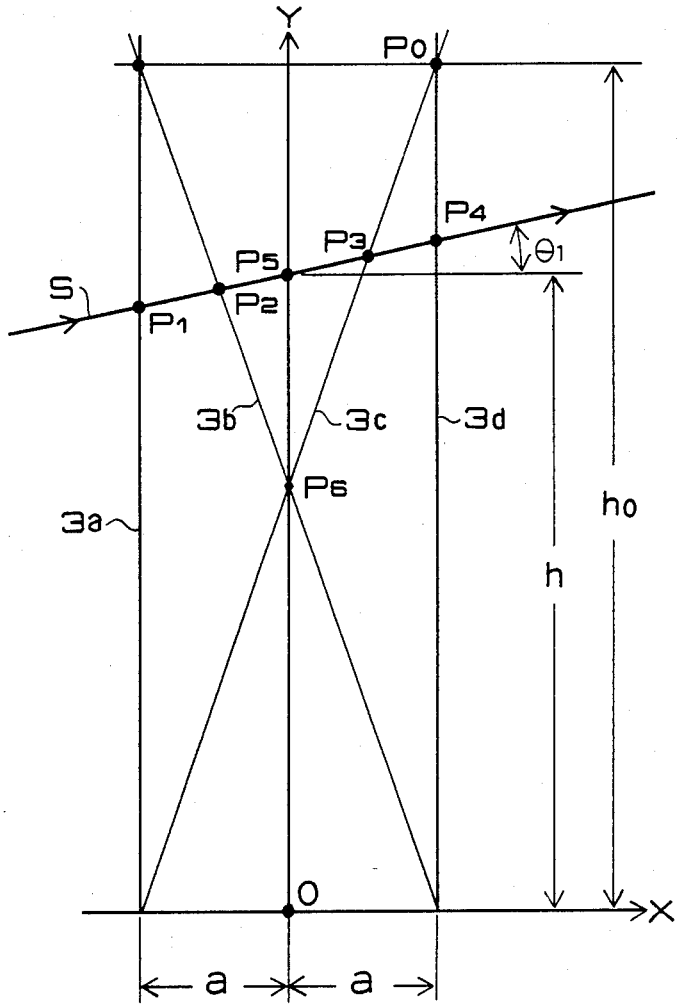
FIG. 3 (PRIOR ART)
FIG. 3 is a graph illustrating principle to determine swing data from intersections between light beams and the swing plane.
Figure 15:
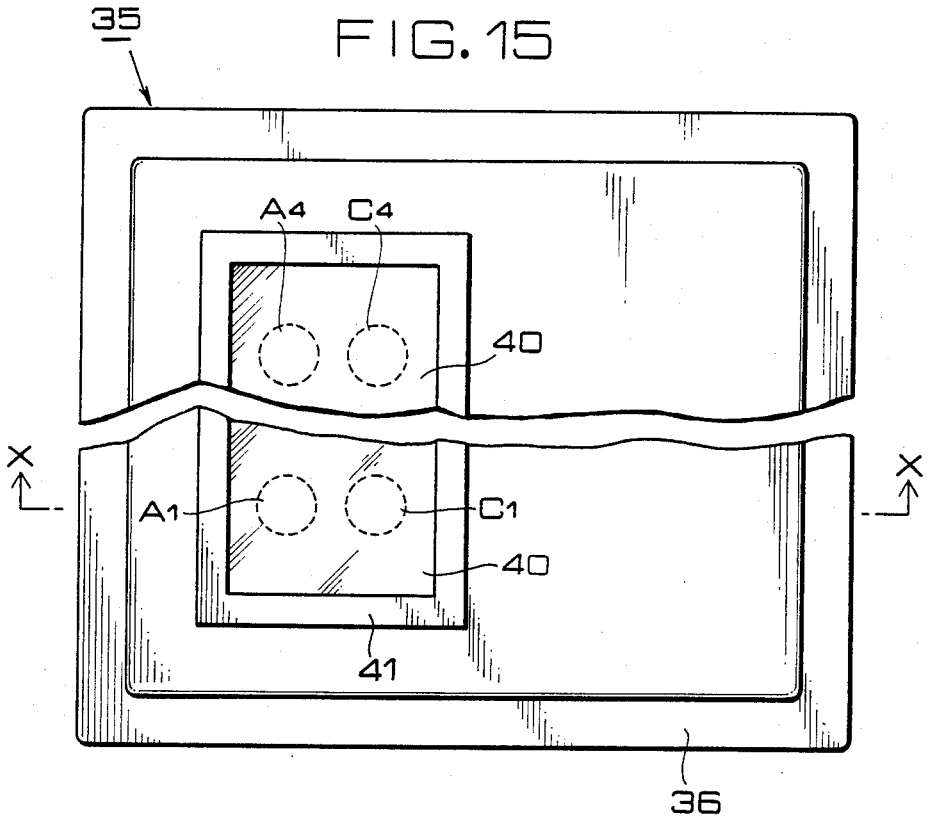
FIG. 15 is a plan view partly cutaway of a swing data measuring device of the invention illustrating part of appearance of a measuring unit thereof.
Figure 16:
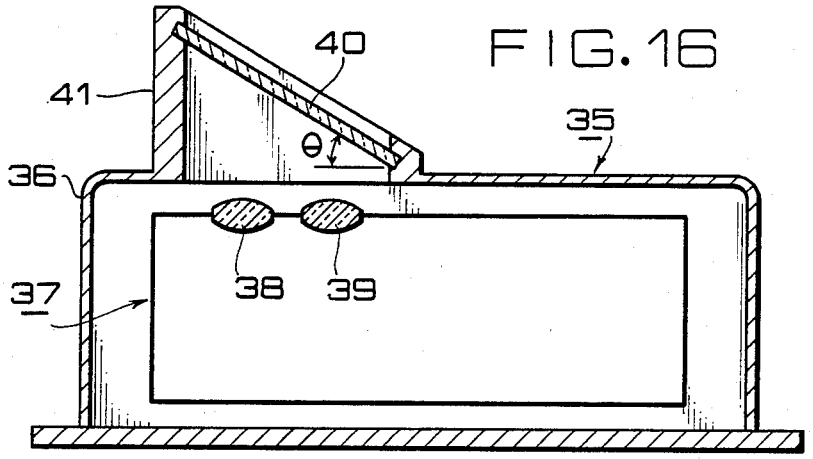
FIG. 16 is a sectional view taken along line X-X of FIG. 15.

The invention further provides novel arrangement of a transparent cover disposed to upper portion of light emitting/receiving means. In FIG. 15 and FIG. 16, a measuring unit 35 of a swing data measuring device has a casing 36 with approximately rectangular form in plan, and an assembly 37 including light emitting-/receiving means is enclosed in the casing 36. The assembly 37 shown as a schematic block in FIG. 16 comprises four light emitting/receiving means for forming four light beams as shown in FIG. 3 or five light emitting/receiving means for forming five light beams as shown in FIG. 10. In FIG. 15, the assembly 37 comprises four pairs of light emitting/receiving means, and the light emitting/receiving means has a lens 38 disposed to upper portion of the light emitting element and a lens 39 disposed to lower portion of the light receiving element.

To upper side of lenses 38, 39 of the light emitting-/receiving means is arranged a cover 40 of the transparent material in order to prevent entering of water or dust into the casing 36. The cover 40 is mounted on the casing 36 through a frame 41 at inclined state by a prescribed angle $\theta$ with respect to the horizontal plane so that the cover 40 is high in the region of the lens 38 for the light emitting element and low in the region of the lens 39 for the light receiving element.

Angle $\theta$ of surface of the cover 40 with respect to the horizontal plane is selected to a suitable angle so that light beam from the light emitting element is transmitted through the lens 38 and directed upwards in nearly the vertical direction, and part of the light beam is reflected on surface of the cover 40 and the reflected light is directed in opposite direction to the lens 39 at side of the light receiving element. When the cover 40 is of glass, value of the angle $\theta$ is preferably 20–30 degrees. When the light emitting element emits infrared ray with wave length of 800 $\mu$m, the cover 40 may be a filter to transmit only the light beam having frequency in this band.

Majority of the light beam which is transmitted from the light emitting element through the lens 38 and directed upwards is further transmitted through the cover 40 and directed upwards, but part of the light beam is reflected on surface of the cover 40. However, since the direction of the reflected light is opposite to side of the lens 39 for the light receiving element, the reflected light is prevented from transmitting through the lens 39 and entering into the light receiving element and the error action caused by such phenomenon can be effectively prevented

What is claimed is:

1. A swing data measuring device wherein swing data of bat swing performed by a baseball player, including level of a swing plane, inclination of the swing plane with respect to the horizontal plane and speed of the bat, is optically detected and the swing data is displayed in digital form, comprising:

a first light emitting/receiving means composed of a first light emitting means for forming a first light beam in approximately vertical direction with respect to the earth and a first light receiving means for receiving a first reflection light beam of the first light beam reflected of the surface of the bat;

a second light emitter/receiving means composed of a second light emitting means for forming a second light beam in parallel to the first light beam and a second light receiving means for receiving a second reflection light beam of the second light beam reflected off the surface of the bat;

a third light emitting/receiving means composed of a third light emitting means for forming a third light beam intersecting the first light beam and a third light receiving means for receiving a third reflection light beam of the third light beam reflected off the surface of the bat;

a fourth light emitting/receiving means composed of a fourth light emitting means for forming a fourth light beam intersecting the second light beam and a fourth light receiving means for receiving a fourth reflection light beam of the fourth light beam reflected off the surface of the bat;

a processing means for processing the swing data based on output signals from the four light receiving means;

a collection means including means for collecting past swing data obtained by swings performed already and means for analyzing the swing data collected;

a display means for displaying the processing result of the processing means and the collection means;

said processing means comprising means for setting lower limit speed and upper limit speed of the bat; and a cancel means for stopping the measurement of swing data when speed of the bat is outside the speed region between set values of the lower limit speed and the upper limit speed.

2. A swing data measuring device as set forth in claim 1, wherein each of the first through fourth light emitting means comprises a light emitting element and a first lens disposed in front of each light emitting element, each of the first through fourth light receiving means comprises a light receiving element and a second lens disposed in front of each light receiving element, the swing data measuring device further comprises a transparent cover for said lenses disposed in front of the light emitting elements and the light receiving elements, and the cover is mounted in inclination with respect to a plane perpendicular to the light beam emitted from the light emitting means so that the cover is far from each of said first lenses and near each of said second lenses.

3. A swing data measuring device as set forth in claim 2, wherein the cover is a filter for transmitting only infrared light with wave length within a prescribed band including wave length of 800 $\mu$m.

4. A swing data measuring device as set forth in claim 2 or 3, wherein said cover is inclined by an angle of 20–30 degrees with respect to the perpendicular plane to the light beam.

* * * * *